United States Patent [19]

Braunisch et al.

[11] Patent Number: 4,975,555

[45] Date of Patent: Dec. 4, 1990

[54] MICROWAVE OVEN WITH TIMER DEVICE

[75] Inventors: Eckart Braunisch, Kimstad; Jan Önnegren, Norrköping, both of Sweden

[73] Assignee: U.S. Philips Corporation, New York, N.Y.

[21] Appl. No.: 419,048

[22] Filed: Oct. 10, 1989

[30] Foreign Application Priority Data

Oct. 17, 1988 [SE] Sweden ..... 8803698

[51] Int. Cl.[5] ..... H05B 6/68

[52] U.S. Cl. ..... 219/10.55 B; 219/10.55 R; 368/9

[58] Field of Search ..... 219/10.55 B, 10.55 R, 219/10.55 E; 368/9, 10, 187

[56] References Cited

U.S. PATENT DOCUMENTS

| | | | |
|---|---|---|---|
| 3,872,277 | 3/1975 | Niu | 219/10.55 B |
| 4,129,769 | 12/1978 | Takagi et al. | 219/10.55 B |
| 4,130,749 | 12/1978 | Tanaka et al. | 219/10.55 B |
| 4,142,082 | 2/1979 | Israel | 219/10.55 B |
| 4,331,855 | 5/1982 | Tanabe | 219/10.55 B |

*Primary Examiner*—Philip H. Leung

*Attorney, Agent, or Firm*—Bernard Franzblau

[57] ABSTRACT

A microwave oven with a timer device driven by a ripple voltage related to the mains frequency. The ripple voltage appears at a circuit point in the microwave oven power supply only during the time when microwave energy is being fed into the oven cavity.

9 Claims, 1 Drawing Sheet

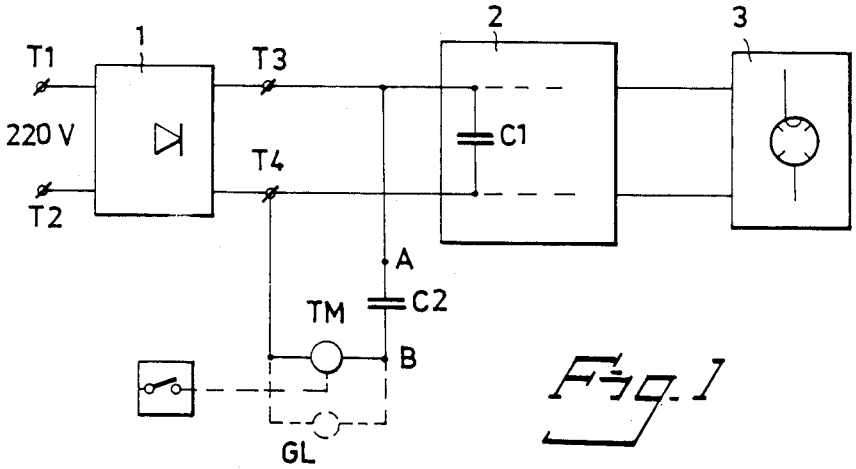
Fig. 1
Fig. 2a
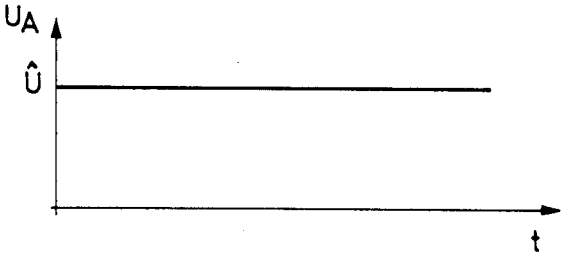
Fig. 2b
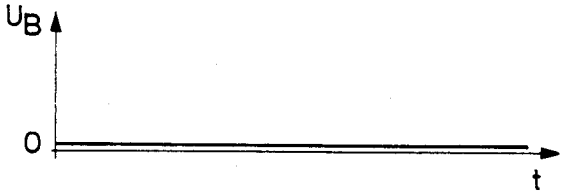
Fig. 3a
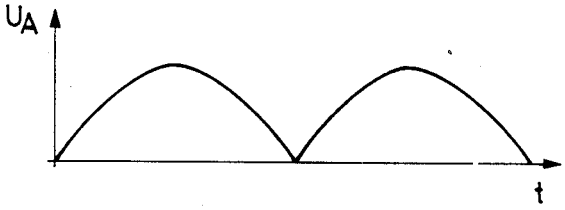
Fig. 3b
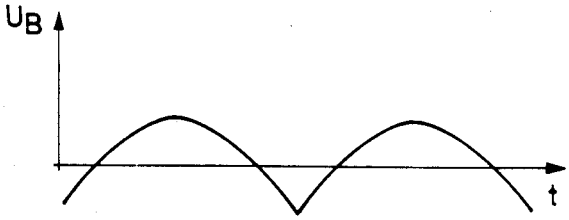

MICROWAVE OVEN WITH TIMER DEVICE

BACKGROUND OF THE INVENTION

This invention is directed to a microwave oven with a timer device for selecting and/or indicating a cooking time, said oven comprising a microwave source fed by a power supply in which the mains voltage is transformed to a rectified high voltage which is supplied to the microwave source, a ripple voltage related to the mains frequency appearing in said power supply during generation of microwave energy by the microwave source.

According to the prior art, said timer device is usually controlled via a control unit included in said microwave oven. The main purpose of said control unit is to control and supervise the cooking procedure in the oven by controlling the microwave energy which is fed to the oven cavity depending on selected control parameters for the actual food. This kind of control of the timer device is used, among others, in Philips microwave oven type AVM 730. A control unit of this type means that a number of active switching components, e.g. transistors, are used in the control circuit of the timer device. In said Philips microwave oven a TRIAC performs the connection of a motor included in the timer device to the mains-AC-voltage when the oven is started. The use of active components means higher costs and moreover an increased complexity of said control unit.

SUMMARY OF THE INVENTION

An object of invention is to provide an apparatus for controlling the timer device in a microwave oven which is less complicated and therefore less costly than prior art solutions.

The aforesaid object of invention is obtained by means of a microwave oven as described in the introduction, which is characterized in that the said timer device comprises a frequency sensitive control signal input which is connected to a circuit point of said power supply in which said ripple voltage appears, whereby the timer device is activated and advanced dependent on the mains frequency during generation of microwave energy in the oven.

An advantage that is obtained by means of the invention is that of a very much simplified control of the timer device by means of a signal appearing exactly during the progress of the cooking procedure.

According to a preferred embodiment the timer device comprises a synchronous motor which is fed via a capacitor connected to the output of a rectifier bridge included in the power supply, whereby the timer device is activated and controlled completely without the use of any active components.

Further novel features are set forth in the following patent claims.

BRIEF DESCRIPTION OF THE DRAWINGS

The invention will be described in more detail in the following description taken in conjunction with and by reference to the accompanying drawings, in which FIG. 1 discloses a timer device which is connected according to the invention to a power supply of the switch mode type, FIG. 2*a* and FIG. 2*b* disclose time diagrams of the voltages at points A and B in FIG. 1 when the power supply is not activated, and FIG. 3*a* and FIG. 3*b* disclose time diagrams of the voltages at points A and B in FIG. 1 for an activated power supply.

DESCRIPTION OF THE PREFERRED EMBODIMENTS

The power supply disclosed in FIG. 1 is fed from the mains (AC supply voltage) via a fullwave rectifier bridge 1 having its input terminals T1, T2 supplied with the mains 220 V.

The output terminals T3, T4 of the rectifier bridge are connected to a resonance circuit included in a switch mode power supply 2 and having a controllable switch and a transformer feeding a driving voltage via a rectifier to a magnetron of the microwave source 3. For a detailed description of the structure and operation mode of the components included in the block 2, see the SE patent application No. 882530-9 (PHZ-88012). A capacitor C1 is provided at the input of said resonance circuit. A capacitor C2 and a synchronous motor TM are connected in series between output terminals T3, T4.

The circuit disclosed in FIG. 1 operates in the following way. When the power supply is inactive, that is when microwave energy is not generated by the microwave source 3, the capacitor C1 is charged to a DC-voltage which corresponds to the peak value of the mains voltage. This condition is illustrated in FIG. 2*a*, showing the voltage at point A as a function of time. A ripple voltage of double the mains frequency emanating from the rectifier bridge is suppressed by the capacitor C1.

The DC-voltage level at point A is blocked by the capacitor C2 which means that the voltage at point B will vary with time as illustrated in FIG. 2*b*, that is a zero voltage appears across the motor TM. Accordingly the timer device is not advanced in this situation.

When the microwave source starts the generation of microwave energy, that is when the power supply is active, the voltage at point A will have the shape as illustrated in FIG. 3*a* as a consequence of the fact that the capacitor C1 is charged and discharged at double the mains frequency. The DC-component of the voltage according to FIG. 3*a* is blocked by the capacitor C2 and a ripple voltage of double the mains frequency appears at point B. Said ripple voltage is shown in FIG. 3*b*. The ripple voltage is supplied to the synchronous motor TM, thus advancing the timer device. Said advance will continue until the power supply is again inactivated and the generation of microwaves is stopped. This may be obtained by having the timer device act upon a mains switch when a preset cooking time is reached. The function of the timer device in this respect corresponds exactly with the prior art and is therefore only schematically illustrated in FIG. 1.

A so called cooking lamp may be connected in parallel with the motor TM in order to be fed as well by the ripple voltage whereby it lights up during activation of the oven. This is indicated by dashed lines in FIG. 1 in which GL represents a dim glowing lamp.

By means of the described circuit, a very much simplified solution is obtained for driving the timer device by means of a signal which automatically appears during feeding of microwave energy to the microwave oven cavity.

In the embodiment described above the timer device comprises a synchronous motor driven by the ripple voltage which appears when the power supply is active. Obviously the ripple voltage also may be used for driving a time measurement device of a different kind, e.g. a pulse counter, to which the ripple voltage is supplied after being adequately pulse shaped. In a power supply of the kind in which the mains voltage is transformed to a high voltage without any prior rectification, a corresponding ripple voltage may be obtained at an adequate circuit point after rectification of the high voltage of mains frequency.

We claim:

1. A microwave oven comprising: a timer device for selecting and/or indicating a cooking time, a microwave energy source energized by a power supply supplied from an AC mains voltage and in which power supply the mains voltage is transformed by a rectifier device to a rectified high voltage which is supplied to the microwave energy source, a ripple voltage related to the mains frequency appearing at a circuit point in the power supply during generation of a microwave energy by the microwave energy source, wherein said timer device comprises a control input with a frequency sensitive element which is connected to the circuit point of said power supply at which said ripple voltage appears, said frequency sensitive element being operative to pass the ripple voltage to the timer device which is thereby activated and advanced dependent on the mains frequency during generation of microwave energy in the oven.

2. A microwave oven as claimed in claim 1, wherein said power supply comprises a switch-mode type power supply including a mains connected rectifier device feeding a resonant circuit, a capacitor coupled to an input of said resonant circuit so as to suppress the ripple voltage when the power supply is inactive, and means connecting the control input of the timer device to the output of the rectifier device.

3. A microwave oven as claimed in claim 2, wherein said rectifier device comprises a full wave rectifier bridge and said frequency sensitive element comprises a further capacitor, wherein said timer device includes a synchronous motor connected in series with said further capacitor between output terminals of the rectifier bridge whereby the synchronous motor is supplied with a ripple voltage of double the mains frequency when the power supply is active.

4. A microwave oven as claimed in claim 1 wherein said rectifier device comprises a full wave rectifier bridge, said circuit point is coupled to an output terminal of the rectifier bridge, said frequency sensitive element comprises a capacitor, and said timer device includes a synchronous motor connected in series with said capacitor to said circuit point so that the synchronous motor is energized by a ripple voltage of double the mains frequency only when the microwave energy source is active.

5. A microwave oven comprising:

a timer device for timing the cooking period of the oven, said timer device including a control input having frequency sensitive means, a power supply having its input coupled to a source of AC supply voltage and its output coupled to a microwave energy source for the oven, said power supply including a transformer-rectifier apparatus responsive to the AC supply voltage for transforming said AC supply voltage into a rectified high voltage having a ripple voltage component related to the frequency of the AC supply voltage, said transformer-rectifier apparatus including a circuit point at which said ripple voltage component is present only during operation of the microwave energy source, and means coupling said timer device control input to said circuit point whereby said frequency sensitive means passes the ripple voltage component to the timer device which in turn is activated and advanced thereby during said operation of the microwave energy source.

6. A microwave oven as claimed in claim 5 wherein said transformer-rectifier apparatus includes a full wave rectifier and said circuit point comprises an output of the full wave rectifier, wherein said timer device includes a motor and said frequency sensitive means comprises a capacitor coupling said motor to said circuit point.

7. A microwave oven as claimed in claim 6 wherein the power supply comprises a switch-mode type of power supply with said full rectifier coupled to terminals for receiving an AC supply voltage, said switch-mode power supply including a resonant circuit coupled to said output of the full wave rectifier, and means coupling a second capacitor to an input of the resonant circuit so as to suppress said ripple voltage component when the microwave energy source is not in operation.

8. A microwave oven as claimed in claim 5 wherein said transformer-rectifier apparatus includes a full wave rectifier and said circuit point comprises an output of the full wave rectifier, wherein said timer device includes a synchronous motor and said frequency sensitive means comprises a capacitor, and means connecting said synchronous motor and said capacitor in a series circuit across the output of the full wave rectifier whereby the synchronous motor is energized by a ripple voltage of twice the AC supply voltage frequency.

9. A microwave oven as claimed in claim 5 wherein said transformer-rectifier apparatus includes a full wave rectifier coupled to input terminals for an AC supply voltage and said circuit point comprises an output of the full wave rectifier, and a capacitor coupled to said output of the rectifier and to said microwave energy source so as to provide a substantially constant voltage level at the circuit point when the microwave energy source is inactive and to provide said ripple voltage component when the microwave energy source is active in the generation of microwave energy for the oven.

* * * * *